US005868124A

United States Patent [19]

Horsch

[11] Patent Number: 5,868,124

[45] Date of Patent: Feb. 9, 1999

[54] QUICK SET RADIUS DRESSER

[76] Inventor: Thomas E. Horsch, 8577 Dixie La., Dearborn Heights, Mich. 48127

[21] Appl. No.: 1,719

[22] Filed: Dec. 31, 1997

[51] Int. Cl.[6] ..... B28D 1/00

[52] U.S. Cl. ..... 125/2; 125/3; 125/8; 451/443; 451/419

[58] Field of Search ..... 451/443, 419, 451/420, 56, 21; 125/2, 3, 5, 8, 11.01, 11.03

[56] References Cited

U.S. PATENT DOCUMENTS

| | | | |
|---|---|---|---|
| 2,351,269 | 6/1944 | Kropf et al. | 451/443 |
| 2,477,418 | 7/1949 | Polk | 125/2 |
| 4,274,388 | 6/1981 | Ivel | 451/56 |
| 4,539,779 | 9/1985 | Donner | 451/56 |
| 4,805,585 | 2/1989 | Halvorsen | 451/443 |
| 5,741,172 | 4/1998 | Trionfetti et al. | 451/443 |

FOREIGN PATENT DOCUMENTS

| | | | |
|---|---|---|---|
| 405057608 | 3/1993 | Japan | 125/11.01 |
| 405069323 | 3/1993 | Japan | 125/11.01 |
| 406055442 | 3/1994 | Japan | 125/11.01 |

*Primary Examiner*—David A. Scherbel
*Assistant Examiner*—Derris H. Banks

[57] ABSTRACT

A radius dresser is provided including a base removably secured to a recipient surface. Also included is a cutting tip holder rotatable and radially slidable with respect to the base. The holder is selectively fixed with respect to the base. The holder has a cutting tip situated along a radius which remains along a direction in which the cutting tip holder is slidable.

6 Claims, 2 Drawing Sheets

QUICK SET RADIUS DRESSER

BACKGROUND OF THE INVENTION

1. Field of the Invention

The present invention relates to radius and angle dressers and more particularly pertains to a new quick set radius dresser for making a dressing radius on grinding wheels faster and easier.

2. Description of the Prior Art

The use of radius and angle dressers is known in the prior art. More specifically, radius and angle dressers heretofore devised and utilized are known to consist basically of familiar, expected and obvious structural configurations, notwithstanding the myriad of designs encompassed by the crowded prior art which have been developed for the fulfillment of countless objectives and requirements.

Known prior art dressers include U.S. Pat. No. 4,180,046; U.S. Pat. No. 4,274,231; U.S. Pat. No. 5,038,746; U.S. Pat. No. 5,003,730; U.S. Pat. No. 4,299,196; and U.S. Pat. No. 4,073,281.

In these respects, the quick set radius dresser according to the present invention substantially departs from the conventional concepts and designs of the prior art, and in so doing provides an apparatus primarily developed for the purpose of making a dressing radius on grinding wheels faster and easier.

SUMMARY OF THE INVENTION

In view of the foregoing disadvantages inherent in the known types of radius and angle dressers now present in the prior art, the present invention provides a new quick set radius dresser construction wherein the same can be utilized for making a dressing radius on grinding wheels faster and easier.

The general purpose of the present invention, which will be described subsequently in greater detail, is to provide a new quick set radius dresser apparatus and method which has many of the advantages of the radius and angle dressers mentioned heretofore and many novel features that result in a new quick set radius dresser which is not anticipated, rendered obvious, suggested, or even implied by any of the prior art radius and angle dressers, either alone or in any combination thereof.

To attain this, the present invention generally comprises a magnet base having a cylindrical configuration with a circular top face, a circular bottom face, and a periphery formed therebetween. The top face has a threaded bore formed in a central extent thereof. A lever is positioned on the periphery with a first orientation for effecting the magnetization of the bottom face of the magnet base. With the lever in the first orientation, the magnet base is adapted for securing with a metallic recipient surface. In its second orientation, the magnet base serves for demagnetizing the magnet base for allowing the removal thereof from the recipient surface. Also included is a spacer having a cylindrical configuration with a circular top face, a circular bottom face, and a periphery formed therebetween with a diameter less than that of the magnet base. The bottom face has a rectilinear recess for receiving a top extent of a plug having a rectilinear configuration. As shown in FIG. 1, the plug includes a bottom extent having a bolt extending downwardly from the spacer in concentric relationship therewith. This is for screwably coupling with the threaded bore of the magnet base. The spacer further having a central conduit extending between the top face of the spacer and a top surface of the top extent of the plug. For reasons that will soon become apparent, the top face of the plug has a threaded aperture formed therein. Next provided is a handle ring having a cylindrical configuration. Similar to the forgoing components, the handle ring has a circular top face, a circular bottom face, and a periphery formed therebetween with a diameter less than that of the magnet base. The periphery of the handle ring is knurled. The top face of the handle ring has a cylindrical recess formed in a central extent thereof which communicates with a central hole formed through the entire handle ring and has a diameter less than that of the cylindrical recess. A radially extending linear recess is formed between the cylindrical recess and the periphery of the handle ring. A pair of flanking threaded apertures are formed adjacent a periphery of the handle ring at a midpoint of the linear recess. As such, a bolt extends through the central hole of the handle ring and the central conduit of the spacer for screwably engaging with the threaded aperture of the top extent of the plug thereof. As best shown in FIG. 3, an adjustable platform is provided including a horizontal plate. The horizontal plate has a guide post formed on a lower surface thereof which extends downwardly therefrom for slidably engaging the linear recess of the handle ring. A pair of parallel guide slots are formed adjacent opposite side edges of the plate. It is through such guide slots that a pair of retaining bolts pass prior to engaging the flanking threaded apertures of the handle ring. By this structure, the adjustable platform is adapted to slide along a radius of the top face of the handle ring and is further selectively fixed in place by way of the retaining bolts. Mounted on a top surface of the adjustable platform is a diamond holder block. The block has a cutting tip extending from an inboard face thereof and extending in parallel relationship with the radius of the top face of the handle ring. Finally, a gauge pin has an upper portion with a cylindrical configuration, a first diameter, and a first length. Associated therewith is a lower portion with a cylindrical configuration, a second diameter less than the first diameter and equal to the diameter of the cylindrical recess of the handle ring, and a second length less than the first length. The upper portion has a semi-cylindrical cut out formed therein with a length half the first length.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new quick set radius dresser apparatus and method which has many of the advantages of the radius and angle dressers mentioned heretofore and many novel features that result in a new quick set radius dresser which is not anticipated, rendered obvious, suggested, or even implied by any of the prior art radius and angle dressers, either alone or in any combination thereof.

It is another object of the present invention to provide a new quick set radius dresser which may be easily and efficiently manufactured and marketed.

It is a further object of the present invention to provide a new quick set radius dresser which is of a durable and reliable construction.

An even further object of the present invention is to provide a new quick set radius dresser which is susceptible of a low cost of manufacture with regard to both materials and labor, and which accordingly is then susceptible of low prices of sale to the consuming public, thereby making such quick set radius dresser economically available to the buying public.

Still yet another object of the present invention is to provide a new quick set radius dresser which provides in the apparatuses and methods of the prior art some of the advantages thereof, while simultaneously overcoming some of the disadvantages normally associated therewith.

Still another object of the present invention is to provide a new quick set radius dresser for making a dressing radius on grinding wheels faster and easier.

Even still another object of the present invention is to provide a new quick set radius dresser that includes a base removably secured to a recipient surface. Also included is a cutting tip holder rotatable and radially slidable with respect to the base. The holder is selectively fixed with respect to the base. The holder has a cutting tip situated along a radius which remains along a direction in which the cutting tip holder is slidable.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
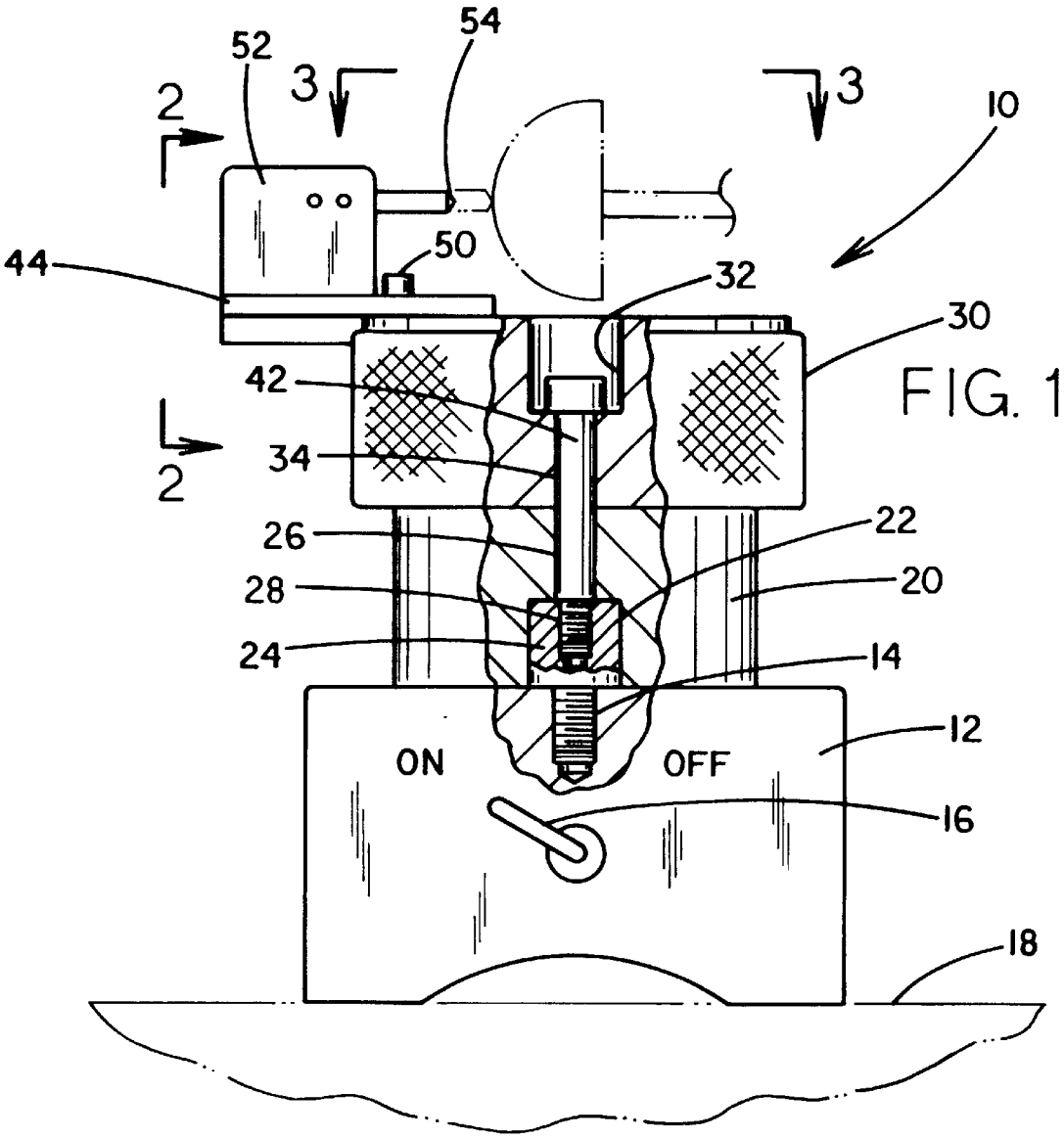
FIG. 1 is a side sectional view of a new quick set radius dresser according to the present invention.
Figure 2:
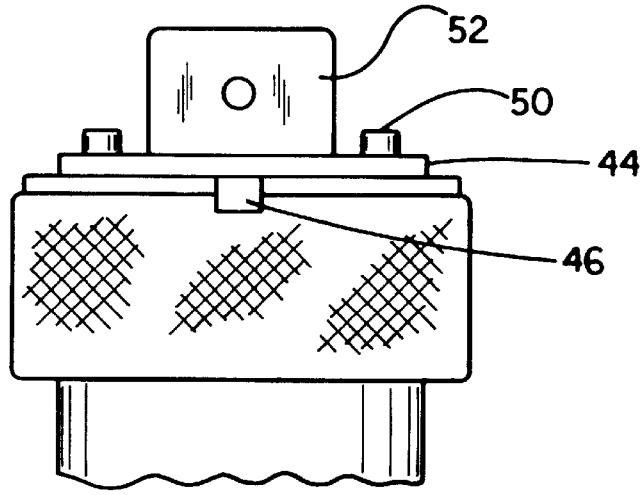
FIG. 2 is a side view of the handle ring and mounting platform of the present invention.

With reference now to the drawings, and in particular to FIGS. 1 through 4 thereof, a new quick set radius dresser embodying the principles and concepts of the present invention and generally designated. by the reference numeral 10 will be described.

The present invention, designated as numeral 10, includes a magnet base 12 having a cylindrical configuration with a circular top face, a circular bottom face, and a periphery formed therebetween. The top face has a threaded bore 14 formed in a central extent thereof. A lever 16 is positioned on the periphery with a first orientation for effecting the magnetization of the bottom face of the magnet base. With the lever in the first orientation, the magnet base is adapted for securing with a metallic recipient surface 18 adjacent a grinding wheel. In its second orientation, the magnet base serves for demagnetizing the magnet base for allowing the removal thereof from the recipient surface. To accomplish this, an electromagnet or a movable high intensity magnet may be employed.

Also included is a spacer 20 having a cylindrical configuration with a circular top face, a circular bottom face, and a periphery formed therebetween with a diameter less than that of the magnet base. The bottom face has a rectilinear recess 22 for receiving a top extent of a plug 24 having a rectilinear configuration. As shown in FIG. 1, the plug includes a bottom extent having a bolt extending downwardly from the spacer in concentric relationship therewith. This is for screwably coupling with the threaded bore of the magnet base. The spacer further having a central conduit 26 extending between the top face of the spacer and a top surface of the top extent of the plug. For reasons that will soon become apparent, the top face of the plug has a threaded aperture 28 formed therein.

Next provided is a handle ring 30 having a cylindrical configuration. Similar to the forgoing components, the handle ring has a circular top face, a circular bottom face, and a periphery formed therebetween. The periphery of the handle ring is knurled. The top face of the handle ring has a cylindrical recess 32 formed in a central extent thereof which communicates with a central hole 34 formed through the entire handle ring and has a diameter less than that of the cylindrical recess.

A radially extending linear recess 36 is formed on the top face of the handle ring between the cylindrical recess and the periphery. A pair of flanking threaded apertures 40 are formed adjacent a periphery of the handle ring at a midpoint of the linear recess. As such, a bolt 42 extends through the central hole of the handle ring and the central conduit of the spacer for screwably engaging with the threaded aperture of the top extent of the plug.

Figure 3:
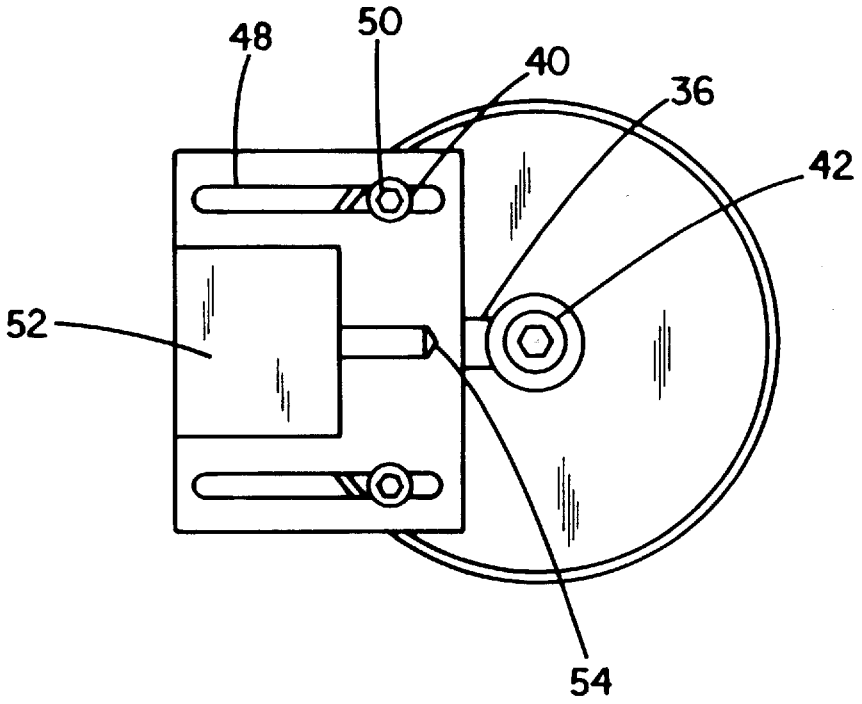
FIG. 3 is a top view of the present invention.
Figure 4:
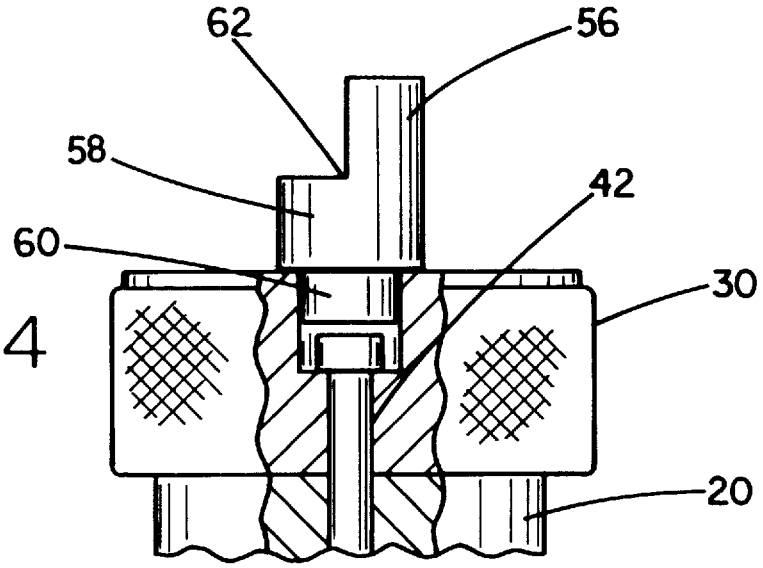
FIG. 4 is a side view of the present invention showing the guide pin.

As best shown in FIG. 3, an adjustable platform 44 is provided including a horizontal plate. The horizontal plate has a guide post 46 formed on a lower surface thereof which extends downwardly therefrom for slidably engaging the linear recess of the handle ring. A pair of parallel guide slots 48 are formed adjacent opposite side edges of the plate. It is through such guide slots that a pair of retaining bolts 50 pass prior to engaging the flanking threaded apertures of the handle ring. By this structure, the adjustable platform is adapted to slide along a radius of the top face of the handle ring and is further selectively fixed in place by way of the retaining bolts.

Mounted on a top surface of the adjustable platform is a diamond holder block 52. The block has a cutting tip 54 extending from an inboard face thereof and extended in parallel relationship with the radius of the top face of the handle ring.

Finally, a gauge pin 56 has an upper portion 58 with a cylindrical configuration, a first diameter, and a first length. Associated therewith is a lower portion 60 with a cylindrical configuration, a second diameter less than the first diameter and equal to the diameter of the cylindrical recess of the handle ring, and a second length less than the first length. The upper portion has a semi-cylindrical cut out 62 formed therein with a length half the first length.

In operation, the user first sets the radius of the unit with the gauge pin. The unit is then positioned on the internal grinder or related machine and secured in place by turning the lever on its magnet. The grinding wheel could then be fed past its diamond nib, thereby dressing it. The present invention possesses a high degree of accuracy thus improving the dimensional accuracy of the wheels that it would be used to dress. Further, it is capable of a small compact size for easy storage.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A radius dresser comprising, in combination:

a magnet base having a cylindrical configuration with a circular top face, a circular bottom face, and a periphery formed therebetween, the top face having a threaded bore formed in a central extent thereof and a lever positioned on the periphery with a first orientation for effecting the magnetization of the bottom face of the magnet base for securing with a metallic recipient surface and a second orientation for demagnetizing the magnet base for allowing the removal thereof from the recipient surface;

a spacer having a cylindrical configuration with a circular top face, a circular bottom face, and a periphery formed therebetween with a diameter less than that of the magnet base, the bottom face having a rectilinear recess for receiving a top extent of a plug having a rectilinear configuration, the plug further including a bottom extent including a bolt extending downwardly from the spacer in concentric relationship therewith for screwably coupling with the threaded bore of the magnet base, the spacer further having a central conduit extending between the top face of the spacer and a top surface of the top extent of the plug which has a threaded aperture formed therein;

a handle ring having a cylindrical configuration with a circular top face, a circular bottom face, and a periphery formed therebetween with a diameter less than that of the magnet base, the periphery of the handle ring being knurled, the top face of the handle ring having a cylindrical recess formed in a central extent thereof which communicates with a central hole formed through the entire handle ring and has a diameter less than that of the cylindrical recess, a radially extending linear recess formed between the cylindrical recess and the periphery of the handle ring, and a pair of flanking threaded apertures formed adjacent a periphery of the handle ring at a midpoint of the linear recess, wherein a bolt extends through the central hole of the handle ring and the central conduit of the spacer for screwably engaging with the threaded aperture of the top extent of the plug thereof;

an adjustable platform including a horizontal plate having a guide post formed on a lower surface thereof and extending downwardly therefrom for slidably engaging the linear recess of the handle ring and a pair of parallel guide slots formed adjacent opposite side edges of the plate through which a pair of retaining bolts pass prior to engaging the flanking threaded apertures of the handle ring, whereby the adjustable platform is adapted to slide along a radius of the top face of the handle ring and is further selectively fixed in place by way of the retaining bolts;

a diamond holder block mounted on a top surface of the adjustable platform adjacent an outboard end thereof with a cutting tip extending from an inboard face of the block and extending in parallel relationship with the radius of the top face of the handle ring; and a gauge pin having an upper portion with a cylindrical configuration, a first diameter, and a first length and a lower portion with a cylindrical configuration, a second diameter less than the first diameter and equal to the diameter of the cylindrical recess of the handle ring, and a second length less than the first length, the upper portion having a semi-cylindrical cut out formed therein with a length half the first length.

2. A radius dresser comprising:

a base removably secured to a recipient surface; and a cutting tip holder rotatable and radially slidable with respect to the base, whereby the holder is selectively fixed with respect to the base, the holder having a cutting tip situated along a radius which remains along a direction in which the cutting tip holder is slidables;

wherein the cutting tip holder is mounted to a platform which is in turn mounted to a handle ring fixed with respect to the base, a top face of the handle ring having a radially extending linear recess for receiving a guide formed on the platform and a pair of flanking threaded apertures, wherein a pair of bolts extend through parallel slots formed in the platform and engage with the threaded apertures.

3. A radius dresser as set forth in claim 2 wherein a spacer is situated between the base and the cutting tip holder.

4. A radius dresser as set forth in claim 2 wherein the base is removably mounted to a recipient surface via a magnetic mechanism.

5. A radius dresser as set forth in claim 2 and further including a gauge pin having an upper portion with a cylindrical configuration removably mounted at a center about which the cutting tool holder rotates, the gauge pin having a semi-cylindrical cut out formed therein.

6. A radius dresser comprising:

a base removably secured to a recipient surface;

a cutting tip holder rotatable and radially slidable with respect to the base, whereby the holder is selectively fixed with respect to the base, the holder having a cutting tip situated along a radius which remains along a direction in which the cutting tip holder is slidable; and a gauge pin having an upper portion with a cylindrical configuration removably mounted at a center about which the cutting tool holder rotates, the gauge pin having a semi-cylindrical cut out formed therein.

* * * * *